United States Patent [19]

Schmitz

[11] Patent Number: 4,820,887

[45] Date of Patent: Apr. 11, 1989

[54] MEMBRANE KEYBOARD BLOCKOUT APPARATUS

[75] Inventor: Robert Schmitz, Hatfield, Pa.

[73] Assignee: Honeywell Inc., Minneapolis, Minn.

[21] Appl. No.: 189,273

[22] Filed: May 2, 1988

[51] Int. Cl.[4] ..... H01H 9/28; H01H 13/70; B41J 5/00; G06C 7/00

[52] U.S. Cl. ..... 200/43.18; 200/43.19; 200/5 A; 235/145 R; 400/472

[58] Field of Search ..... 200/5 A, 52 R, 156 B, 200/302.2, 333, 334, 43.01, 43.16, 43.18, 43.19, 43.21; 235/145 R; 400/472, 663

[56] References Cited

U.S. PATENT DOCUMENTS

| | | | |
|---|---|---|---|
| 3,333,069 | 7/1967 | Anderson | 200/43.19 |
| 3,860,711 | 1/1975 | Lynn et al. | 200/333 X |
| 3,906,814 | 9/1975 | Magnussen | 200/43.18 X |
| 4,497,987 | 2/1985 | Melys | 200/43.19 |

*Primary Examiner*—J. R. Scott

*Attorney, Agent, or Firm*—Mitchell J. Halista; Albin Medved

[57] ABSTRACT

A membrane keyboard blockout apparatus for a keyboard having an array of a plurality of flexible key members in respective ones of a plurality of apertures arranged in a grid forming the keyboard includes a cover plate dimensioned to span a flexible key member and to provide a tight fit within an aperture defining a key member. The cover plate has a thickness providing a substantially inflexible configuration in response to normal operator manipulation and a plurality of corner support pedestals contacting respective corners of the flexible key member when the cover plate is inserted in a key member aperture. Thus, the pedestals provide a support between the cover plate and the flexible key member at the edges of the key member to preclude, in combination with the inflexible structural characteristic of the cover, an actuation of the flexible key member under the cover.

12 Claims, 1 Drawing Sheet

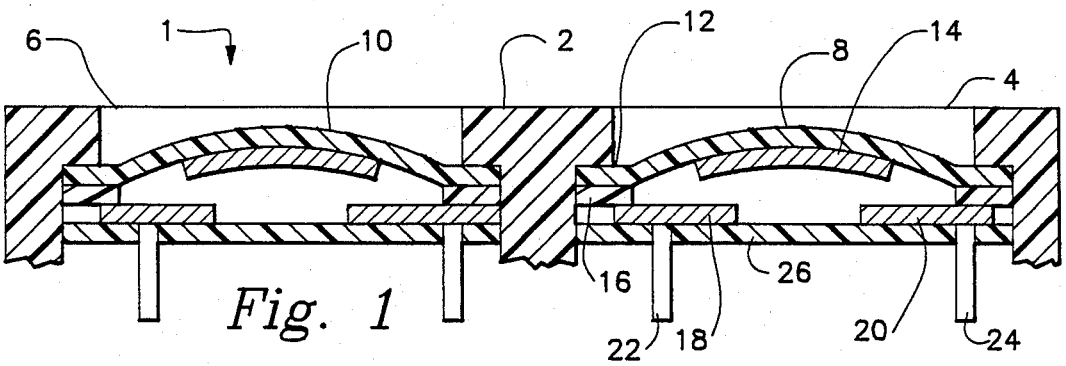
Fig. 1
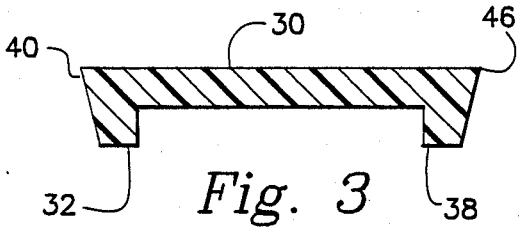
Fig. 3
Fig. 2
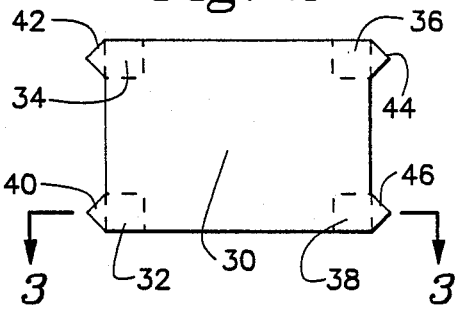
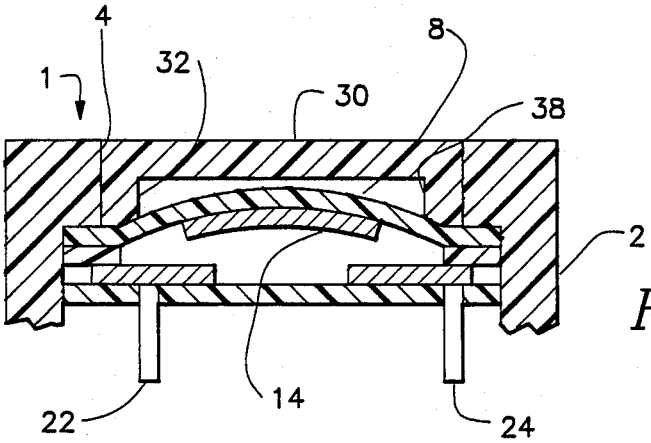
Fig. 4
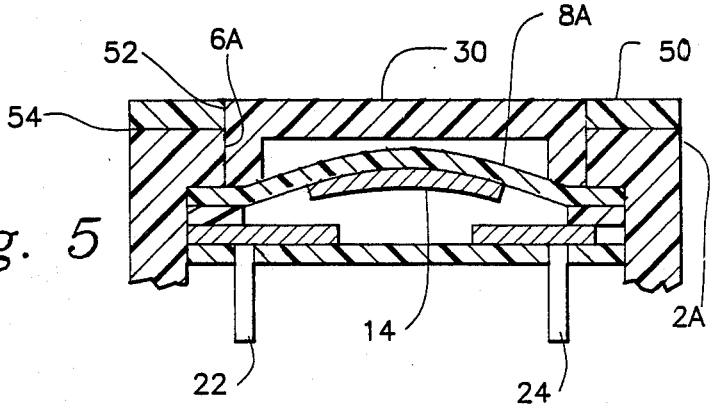
Fig. 5

MEMBRANE KEYBOARD BLOCKOUT APPARATUS

BACKGROUND OF THE INVENTION

1. Field of the Invention

The present invention relates to membrane switches. More specifically, the invention is directed to a membrane switch keyboard apparatus.

2. Description of the Prior Art

Membrane switch keyboards are well-known in the art as shown in U.S. Pat. Nos. 3,860,771; 3,995,126 and 4,423,294. Membrane keyboard devices include an array of elastic bubble members or keys corresponding to an array of individual switching units. The bubble members are actuated or deformed by the touch of an operator to cause the selected bubble member to be deflected whereby to provide a deflection of an associated flexible electrically conductive member to provide an electrically conductive path or bridge between adjacent first and second electrode members. While such membrane keyboard devices have found great acceptance, particularly in the field of computer keyboards, by virtue of the feel of the keyboard during actuation which approximates that of a conventional switch by providing tactile feedback to the operator, they have also inherently exhibited a lack of security by a failure to provide a means for preventing an operation of certain ones of the bubble members by the operator. Thus, if the keyboard is to be limited in certain applications to particular functions, it would be desirable to provide a means to lock out certain ones of the bubble member keys to prevent an operator from either inadvertently or deliberately actuating incorrect keyboard switches and to simplify a keyboard for a particular application by reducing the number of operator accessible keys.

SUMMARY OF THE INVENTION

An object of the present invention is to provide an improved membrane keyboard lockout apparatus.

In accomplishing this and other objects, there has been provided, in accordance with the present invention, a blockout apparatus for a membrane keyboard apparatus utilizing key members accessed for operation through respective keyboard frame apertures including a cover means having a cover plate dimensioned to span a key member of the keyboard, to tightly fit within a respective one of the apertures providing access to the key member and to provide a substantially inflexible structure and a plurality of support pedestals located on a common surface of the cover and arranged to contact adjacent peripheral areas of a key member upon a completed insertion of the cover plate in a respective one of the apertures to prevent an axial motion of the cover plate whereby operation of an associated key member is precluded within the aperture.

BRIEF DESCRIPTION OF THE DRAWINGS

A better understanding of the present invention may be had when the following detailed description is read in connection with the accompanying drawings in which:

FIG. 1 is a cross-sectional illustration of a membrane keyboard apparatus,

FIG. 2 is a top view of a blockout cover for a membrane keyboard apparatus according to the present invention, FIG. 3 is a cross-sectional illustration of the blockout cover shown in FIG. 2 taken along lines 3—3, FIG. 4 is a cross-sectional illustration of the blockout cover shown in FIGS. 2 and 3 in an inserted position in the keyboard apparatus shown in FIG. 1 and FIG. 5 is alternate embodiment of the blockout cover of the present invention.

DESCRIPTION OF THE PREFERRED EMBODIMENT

Referring to FIG. 1 in more detail, there is shown an example of a keyboard apparatus 1 having a frame 2 of a high impact plastic material, e.g., polypropylene, polysterene, etc., such plastics being well-known in the art. The frame 2 is provided with a plurality of apertures 4,6 of which two are shown in FIG. 1, forming a grid or matrix defining locations of keyboard switch elements. Within each aperture there is located a flexible semi-circular plastic bubble member having a top surface below the face of the frame 2. For example, a bubble member 8 is located in aperture 4 and a bubble member 10 is located in aperture 6. The flexible members 8,10 may be of any suitable thermoplastic or thermosetting resilient and flexible plastic material, e.g., polypropylene, polyethelene, polyurethane, etc. The peripheral edges of each of the bubble members are captured beneath recesses in the frame 2 surrounding respective ones of the apertures. Thus, bubble member 8 has its peripheral edge extending beneath a recess or step 12 in the frame 2 surrounding the aperture 4.

The following description is limited to a typical key element, e.g., bubble member 8. A flexible electrically conductive layer is located on an inner surface of each of the bubble members to provide an electrically conductive path upon an actuation of a switch element. Such flexible conductive layers are also well-known in the art. Thus, a first bubble member 8 has a flexible conductive layer 14 on an inner surface thereof arranged in contact with the bubble member 8 and movable therewith. Each bubble member is held against its respective recess by an electrically insulating ring, e.g., ring 16, arranged to contact bubble member 8. A pair of electrically conductive layers are spaced apart within the switch element and are arranged to be bridged by the flexible conductive layer upon an actuation of the bubble member. For example, a pair of electrically conductive elements 18,20 are spaced from flexible conductive layer 14 attached to bubble member 8. The outer edges of the layers 18,20 are arranged to contact the ring 16. A pair of electrically conductive pins 22,24 are connected to respective ones of the conductive layers 18,20. The conductive layers 18,20 are supported by an electrically non-conductive bottom cover 26 through which the conductive pins 22,24 extend. While only one of the switch elements has been described in detail, it should be noted that all of the switch elements in a keyboard have substantially the same structure. In operation, when the bubble member 8 is actuated by the fingertip of an operator pressing on the outer surface of the bubble member 8, the bubble 8 provides a snap action to bring the flexible conductive layer 14 in contact with the conductive elements 18,20 to provide a switch operation.

In FIG. 2, there is shown a blockout cover according to the present invention for use with the membrane keyboard shown in FIG. 1. The blockout cover includes a plate 30 of electrically insulating rigid material, e.g., the same material as the frame 2, having a plurality, e.g., four, of support legs or pedestals 32,34,36 and 38 arranged at the respective corners of plate 30. A plurality of projections or ribs, e.g., four, 40,42,44 and 46 are also arranged to extend outwardly from a peripheral surface of the plate 30 at respective corners of the plate 30. A cross-sectional illustration of the cover shown in FIG. 2 taken along lines 3—3 is shown in FIG. 3. The plate 30 is arranged to have a thickness which makes the plate 30 structurally stiff and substantially non-resilient under normal operating conditions effected by an operator, i.e., the plate 30 would be negligibly deflected. The thickness of the plate 30 would also preferably be effective to locate an outer surface of the plate 30 flush with an outer surface of the frame 2 when the plate 30 is inserted in an aperture in the frame 2 as described hereinafter. The width of the plate 30 is dimensioned to fit within the apertures, e.g. apertures 4,6 of the keyboard 1 shown in FIG. 1. The projections 40,42,44 and 46 "crush" or deform upon an insertion of the plate 30 in an aperture to provide an interference fit with the wall of the aperture to retain the plate 30 very tightly in the aperture. While the plate 30 has been illustrated in a substantially square or rectangular configuration, other configurations matching the apertures may be used.

The legs, or pedestals, 32,34,36 and 38 are arranged to contact a peripheral edge of the bubble member, e.g., bubble member 8 in an inserted state of a blockout cover in an aperture as shown in the cross-sectional illustration in FIG. 4. As may be seen from this illustration, the pedestals 32,34,36 and 38 contact the peripheral edge of the bubble member 8 and are supported thereby. Preferably, the pedestals 32,34,36 and 38 are arranged to support the plate 30 out of contact with the bubble member 8 to eliminate any possibility of affording a means for operating the respective keyboard switch. Accordingly, the pedestals 32,34,36 and 38 prevent further axial motion of the cover plate 30 in the aperture 4 after a completed insertion of the cover plate 30 in the aperture 4. Concurrently, the projections 40,42,44,46 provide an interference fit with an inner peripheral wall of the aperture 4. The thickness of the plate 30 and the restraint produced by the pedestals 32,34,36 and 38 preclude an operator from normally depressing the bubble member 8 to provide a switching operation by preventing further axial motion of the cover plate 30. Thus, the plate 30 forms a blockout for selected ones of the keyboard switch elements. The projections 40,42,44 and 46 serve to retain the plate 30 very tightly in the aperture and to prevent an easy withdrawal of the blockout cover from the aperture.

In FIG. 5, there is shown an alternate embodiment of the present invention which may be used with a keyboard wherein an outer surface of the bubble member 8A extends flush with an outer surface of the frame 2A at a frame aperture 6A. Alternatively, this embodiment may also be used with a keyboard wherein the walls of the apertures are slanted, i.e., not vertical, and the plate 30 would not be properly retained in the aperture. In this embodiment, a cover grid 50 is provided with an aperture 52 for accommodating the plate 30 and is suitably attached, e.g., adhesive bonded by adhesive layer 54, to the frame 2A. The operation of the plate 30 with respect to the cover grid 50 is similar to that described above with respect to the keyboard shown in FIG. 1.

Accordingly, there has been provided, in accordance with the present invention, an improved membrane keyboard blockout apparatus.

The embodiments of the present invention in which an exclusive property or privilege is claimed are defined as follows:

1. A blockout apparatus for a membrane keyboard utilizing key members accessed for operation through respective keyboard surface frame apertures comprising a cover means including a cover plate dimensioned to span a key member of the keyboard, to tightly fit within a respective one of the apertures providing access to the key member and to provide a substantially inflexible structure and a plurality of support pedestals located on a common surface of said cover plate and arranged to contact adjacent peripheral areas of a key member upon a completed insertion of said cover plate in a respective one of the apertures to prevent further axial motion of said cover plate within the aperture whereby operation of the associated key member is precluded.

2. An apparatus as set forth in claim 1 wherein said cover means includes at least one outwardly extending projection on a peripheral edge on said plate and arranged to provide an interference fit between said plate and a wall of an associated one of the apertures.

3. An apparatus as set forth in claim 1 wherein four of said support pedestals are provided on said cover plate.

4. An apparatus as set forth in claim 3 wherein said plate is substantially rectangular and said pedestals are located on respective corners of said plate.

5. An apparatus as set forth in claim 2 wherein four of said projections are provided on said cover plate.

6. An apparatus as set forth in claim 5 wherein said plate is substantially rectangular and said projections are located on a periphery of said plate at respective corners of said plate.

7. An apparatus as set forth in claim 1 wherein said cover plate is made of the same material as the keyboard frame containing the apertures.

8. An apparatus as set forth in claim 1 wherein said support pedestals are dimensioned to engage the aperture wall to support said cover plate flush with an adjacent surface of the keyboard surrounding the apertures.

9. An apparatus as set forth in claim 1 wherein said cover means further includes a cover grid having at least one aperture therein corresponding in size and location to a corresponding one of the apertures in the keyboard frame and attaching means for retaining said cover grid on said keyboard frame with said aperture in said cover grid axially aligned with the corresponding aperture in the keyboard with said aperture in said cover grid being dimensioned to accept said cover plate whereby said cover plate is tightly retained in said aperture in said cover grid and said support pedestals extend to peripherally contact the respective key member while maintaining said plate in said cover grid and spaced from a respective key member.

10. An apparatus as set forth in claim 9 wherein said cover plate is made of the same material as said cover plate.

11. An apparatus as set forth in claim 10 wherein said cover plate is made of the same material as the keyboard frame containing the apertures.

12. An apparatus as set forth in claim 9 wherein said attaching means includes an adhesive bond between said cover grid and said keyboard frame.

* * * * *